US009194204B2

(12) United States Patent
Hiorth et al.

(10) Patent No.: US 9,194,204 B2
(45) Date of Patent: Nov. 24, 2015

(54) DEVICE FOR CARRYING A REPLACEMENT SAFETY VALVE IN A WELL TUBE

(75) Inventors: Espen Hiorth, Trondheim (NO); Terje Stormo, Saupstad (NO)

(73) Assignee: Interwell Technology AS, Ranheim (NO)

( * ) Notice: Subject to any disclaimer, the term of this patent is extended or adjusted under 35 U.S.C. 154(b) by 777 days.

(21) Appl. No.: 13/520,825

(22) PCT Filed: Jan. 10, 2011

(86) PCT No.: PCT/NO2011/000011

§ 371 (c)(1),
(2), (4) Date: Jul. 6, 2012

(87) PCT Pub. No.: WO2011/084073

PCT Pub. Date: Jul. 14, 2011

(65) Prior Publication Data

US 2013/0068448 A1 Mar. 21, 2013

(30) Foreign Application Priority Data

Jan. 8, 2010 (NO) ..... 20100028

(51) Int. Cl.
*E21B 33/12* (2006.01)
*E21B 34/10* (2006.01)

(52) U.S. Cl.
CPC ..... *E21B 33/12* (2013.01); *E21B 34/105* (2013.01)

(58) Field of Classification Search
CPC ..... E21B 33/12; E21B 22/124; E21B 33/128; E21B 33/122; E21B 33/129; E21B 34/105
See application file for complete search history.

(56) References Cited

U.S. PATENT DOCUMENTS

| | | | | |
|---|---|---|---|---|
| 4,069,865 | A * | 1/1978 | Gazda et al. | 166/113 |
| 4,151,875 | A | 5/1979 | Sullaway | |
| 4,349,204 | A * | 9/1982 | Malone | 277/334 |
| 2002/0180159 | A1* | 12/2002 | Nakamura et al. | 277/500 |
| 2003/0000710 | A1 | 1/2003 | Turley et al. | |
| 2006/0005963 | A1 | 1/2006 | Hiorth et al. | |
| 2009/0095487 | A1* | 4/2009 | Xu et al. | 166/373 |
| 2009/0188664 | A1* | 7/2009 | Smith et al. | 166/70 |
| 2011/0048744 | A1* | 3/2011 | Conner et al. | 166/387 |

OTHER PUBLICATIONS

International Search Report and Written Opinion dated Apr. 20, 2011.

* cited by examiner

*Primary Examiner* — Nicole Coy
*Assistant Examiner* — Kristyn Hall
(74) *Attorney, Agent, or Firm* — Alix, Yale & Ristas, LLP

(57) ABSTRACT

Device for carrying a replacement safety valve in a well tube, with a straddle structure for placement inside a damaged "Down Hole Safety Valve" nipple seal area. It is comprising a pair of sealing assemblies (15, 16) to be activated upon setting of the device to seal said nipple seal area, and a locking dog assembly (17) for locking the device in the well tube, said elements being carried by a tubular mandrel (12). At least one of the sealing assemblies (15, 16) comprises a expandable element (22; 34) being activated by a pair of annular press elements (19, 20).

5 Claims, 3 Drawing Sheets

DEVICE FOR CARRYING A REPLACEMENT SAFETY VALVE IN A WELL TUBE

Figure 1:
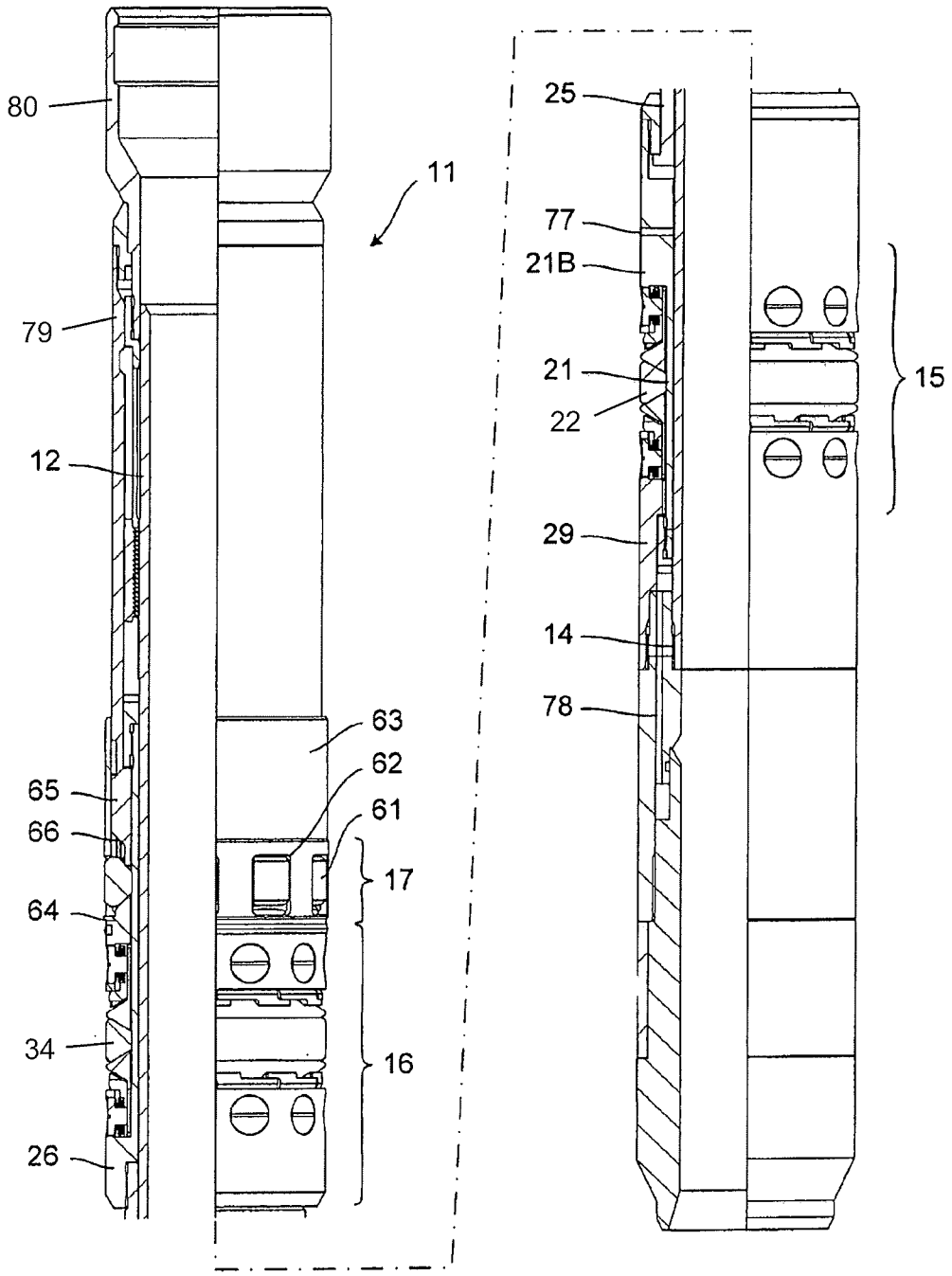

The invention relates to a device for carrying a replacement safety valve in a oil or gas well, particularly with a straddle structure for placement inside a damaged "Down Hole Safety Valve" nipple seal area.

FIELD OF THE INVENTION

Oil and gas well operators have been facing a challenge on how to avoid recompletion of wells where the nipple seal area inside the "Down Hole Safety Valve" (DHSV) is damaged, for instance due to well interventions or corrosion. Various methods have been used including standard insert "Wireline Retrievable Surface Controlled Subsurface Safety Valve" (WRSCSSV), with normal and oversize swell packing elements and honing of the upper and lower seal area prior to installing the insert.

To have the DHSV working properly is vital for the security of the well. If the DHSV is damaged the alternatives are to repair it using one of the above mentioned methods, or set a retrievable bridge plug above the DHSV area and leave the well shut in or do a recompletion of the well. To leave the well shut in is not a good option since it cannot be used for production or injection. To recomplete the well is very expensive since a rig is needed for this.

The above mentioned methods of repairing a damaged DHSV-nipple seal area's have failed or been too unsafe.

OBJECTS

The main object of the invention is to provide a generally improved device for carrying a replacement down hole safety valve.

A further object is to provide such a carrier with improved sealing properties. To this end, it is an object to provide improved sealing means to allow the insertion of a DHSV carrier in the most damaged wells.

It is also an object to improve the locking dog suspension to enhance the operation of the locking dogs. The locking dog suspension should be easy to install and maintain a reliable tension on the locking dogs.

THE INVENTION

The invention is defined in claim 1. Further details are described in the sub-claims.

The device for inserting a replacement safety valve in a well tube, is based on a straddle structure for placement inside a damaged "Down Hole Safety Valve" nipple seal area, comprising a pair of sealing assemblies to be activated upon setting of the device to seal said nipple seal area, and a locking dog assembly for locking the device in the well tube, said elements being carried by a tubular mandrel.

The main novel features are that at least one of the sealing assemblies comprises an expandable element being activated by a pair of annular press elements.

The straddle device is using expandable elements which will allow the sealing elements of the sealing assemblies to be shaped according to the damaged surface inside in the seal area. In addition each element may be equipped with expanding anti-extrusion backup rings on both sides, trapping the element so it has nowhere to go when differential pressure is applied. The straddle device is using the existing nipple profile and no-go for anchoring and is equipped with locking dogs to fit this profile. A commercial safety valve, e.g. a Schlumberger WRDP valve, is made up to the bottom of the straddle, this is then operated by surface control line pressure.

By using a sealing assembly according to the invention, the ability of the DHSV carrier device to seal even badly damaged wells is enhanced.

The invention also comprises further novel features as stated in claims 2 to 7, including a novel locking dog suspension.

The novel device according to this invention will bring several advantages over prior art technology:

- Uses existing sealing surfaces of old DHSV
- Better sealing properties
- Anchoring module design maximizes locking contact area
- Sealing module construction enhances safety and reliability
- Suitable interface for replacement safety valve
- Easier mounting

LIST OF FIGURES

Figure 2:
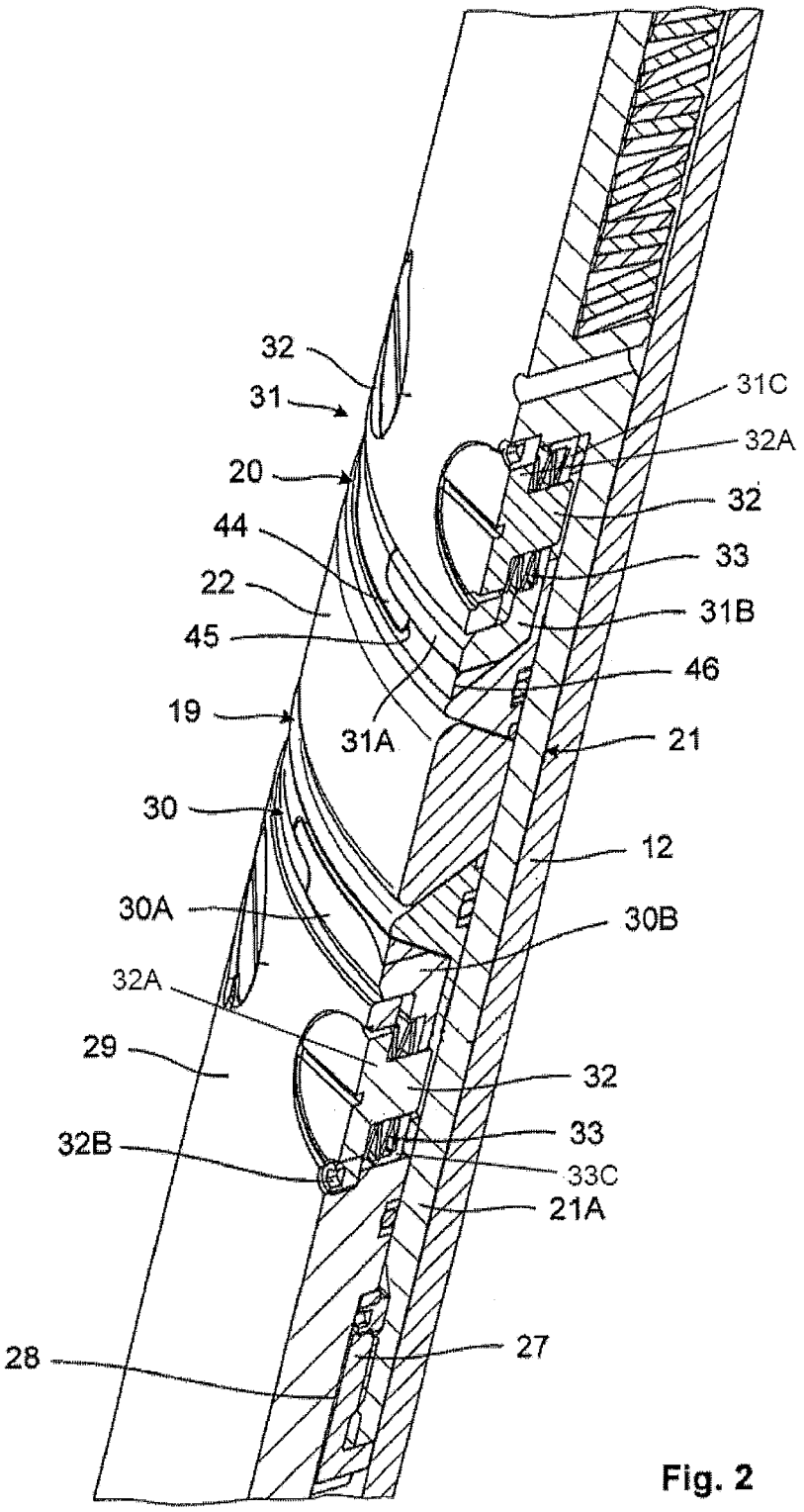
Figure 3:
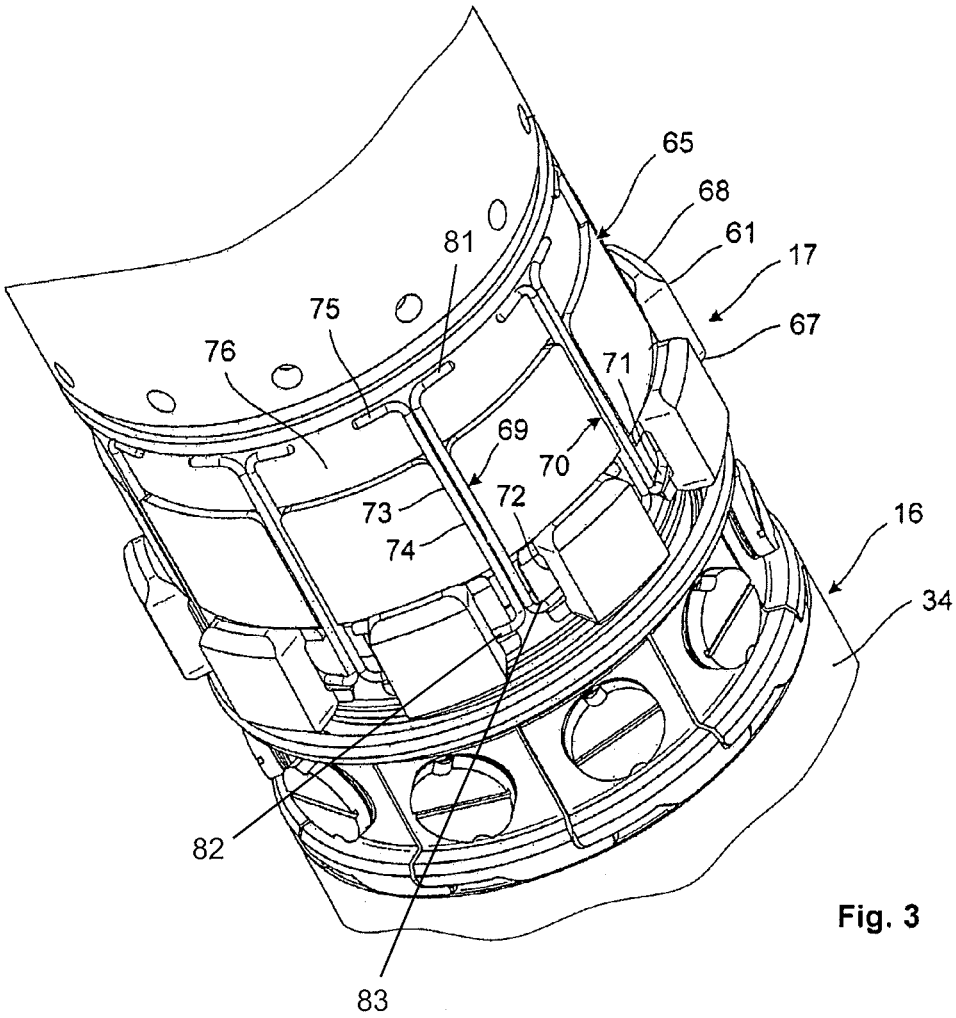

FIG. 1 shows a partly sectioned side view of an embodiment of a safety valve carrier according to the invention, FIG. 2 shows a sectioned perspective view of the lower sealing assembly of the safety valve carrier of FIG. 1, while FIG. 3 shows a perspective view of the upper sealing assembly, with the locking dog housing removed to show the arrangement of the locking dogs.

DESCRIPTION OF EMBODIMENTS

FIG. 1 is showing a side view of the main part of a replacement safety valve carrier (straddle device) 11, the drawing having on the left side an axial and radial cross section of the elements of this carrier. Centrally in the replacement safety valve carrier 11 a mandrel tubing 12 is arranged. The mandrel tubing 12 is connected to the outer part of the carrier 11 by a series of radial shear screws in the upper region. Further, the lower end of the mandrel tubing 12 is connected with threads 14 to a tubular sleeve or nose, which is carrying the replacement safety valve not shown. The replacement safety valve may be of prior art design.

The replacement safety valve carrier 11 has a tubular structure carrying

- a lower sealing assembly 15,
- an upper sealing assembly 16, and
- a locking dog assembly 17 arranged adjacent to the upper sealing means 16 on its upper side.

The lower and the upper sealing assemblies 15, 16 are providing a straddle structure.

According to the invention, the lower sealing assembly 15 and the upper sealing assembly 16, comprise multiple elements.

The Lower Sealing Assembly

In FIG. 2 an embodiment of a lower sealing assembly 15 is shown. The lower sealing assembly 15 comprises a lower and an upper cone ring 19, 20 respectively, arranged on a tubular lower sealing mandrel 21. Between the lower and the upper cone rings, an annular expandable sealing element 22 is arranged. The expandable sealing element 22 has a trapezoidal section with radially diverging sides and being made of a resilient material, such as HNBR.

The tubular mandrel 21 is facing the mandrel tubing 12 and being connected to a sleeve 25 connecting it to a corresponding upper sealing mandrel 26 carrying the upper sealing assembly 16. (FIG. 1)

The lower sealing mandrel 21 is comprising a sleeve 21A carrying a lower nut mandrel 27 which is slidable in an annular recess 28 in a lower sealing backup housing 29. The upper end of the lower sealing backup housing 29 engages the lower sealing cone ring 19 with an intermediate annular lower sealing backup 30.

Similarly, an annular upper sealing backup 31 is arranged between the upper cone ring 20 and a upper part 21B of the lower sealing mandrel 21 functioning as an upper sealing backup housing.

The sealing backups 30 and 31 each comprises an annular row of overlapping arched sealing backup elements 30A and 31A, respectively. Each backup element 30A and 31A comprises an outer sealing part 30B and 31B and an inner leg 30C and 31C.

The sealing backups 30 and 31 are attached to the lower sealing backup housing 29 and the upper sealing backup housing 21B respectively, with ten bolts 32 each. Each spring bolt 32 is carrying a set of dish springs 33.

The head 32A of each bolt 32 has threads for engaging radial holes in the respective housings, being locked by radial locking screws 328. The shanks of the bolts 32 are sliding in an opening in the leg 30C and 31C respectively, of the associated backup element 30A and 31A.

The expandable sealing element 22 is activated by the relative axial movement of the lower sealing backup housing 29 and the upper sealing backup housing 21B at the setting of the device according to the invention.

The Upper Sealing Assembly

The upper sealing assembly 16 is corresponding generally to the lower sealing assembly 15, having an expandable sealing element 34 (FIG. 1).

The Sealing Backup Assembly

Each sealing backup assembly 30 and 31 comprises an annular chain of ten sealing backup elements 30A and 31A, respectively. Each sealing backup element comprises an outer, arched sealing backup part 30B and 31B, respectively, with a circumferential wing 44 on one side and a corresponding slot 45 on the other to allow overlapping of neighboring sealing backup elements. Thus the sealing backup elements will have a closing annular face against the outer rim of the expandable sealing element 22, 34, to restrict the axial expansion of the sealing element.

The Locking Dog Assembly

To lock the device according to the invention in the well tube, an annular row of nine locking dogs 61 are arranged over the upper sealing assembly 16. The locking dogs 61 are arranged in openings 62 in a locking dog housing 63. The locking dog housing 63 is carrying an axially slideable sleeve 65. The lower end of the sleeve 65 has a chamfered face 66 facing the upper end of the locking dogs 61 to press them radially outward when setting the device.

In FIG. 3, the locking dog housing 63 of FIG. 1 is omitted for clarity.

Each of the locking dogs 61 being a block with chamfered lower and upper edges 67, 68, is carried by a pair of axial torsion springs 69, 70. Each torsion spring 69, 70 has a central spring rod 73. The lower end of this rod may have a C-leg 71 engaging a slot 72 in the side of the locking dog 61. The connection of the torsion springs 69, 70 to the locking dogs 61 may have other suitable embodiments.

The central rods 73 of the torsion springs 69, 70 are extending through a longitudinal slot 74 in the sleeve 65.

At the upper end, each torsion spring 69, 70 has a L-leg 75 extending into an annular slot 76 of the locking dog housing 65. The width of the annular slot 76 is dimensioned to take the movement of the L-legs 75 between the end positions, from setting to locking.

The torsion springs 69, 70 are pressing the locking dogs 61 inward. In the set position of the device according to the invention, with the no-go 64 engaging a shoulder in the tubular safety valve housing 18, the locking dogs 61 are forced radially outward by the chamfered lower end 66 of the locking dog cone housing 65.

The arrangement of the locking dogs 61 is making the elements easy to manufacture. The locking dogs according to the invention will have a larger area of contact than prior art locking dogs. Additionally, the torsion springs, acting in pairs, will provide balanced forces acting on the locking dogs. The mounting of the torsion springs 69, 70 is easy.

The device according to the invention is providing a path for hydraulic fluid to the replacement safety valve through a radial hole 77 in the upper backup housing 21B and an axial hole 78 in the lower part of the device. Said holes 77 and 78 are interconnected by the sleeve 21.

The upper part of the device comprises a tubular extension 79 of the sleeve 65 with an upper fishing neck 80. The design of the connection of the extension 79 to the mandrel 12 belongs to prior art technology.

The invention claimed is:

1. A device for carrying a replacement safety valve in a well tube with a straddle structure for placement inside a damaged "Down Hole Safety Valve" nipple seal area, comprising a pair of sealing assemblies (15, 16) to be activated upon setting of the device to seal said nipple seal area, and a locking dog assembly (17) for locking the device in the well tube, said sealing assemblies and locking dog assembly being carried by a tubular mandrel (12), wherein at least one of the sealing assemblies (15, 16) comprises an expandable element (22; 34) being activated by a pair of annular press elements (19, 20), wherein each locking dog (61) is provided with a pair of axially extending torsion rods (69, 70) to press the locking dogs (61) radially inward and each of the pair of torsion rods (69, 70) has an outer end and an inner end, the outer ends (75, 81) extending into and being axially movable in a circumferential groove (76), while the inner ends (82, 83) are each engaged with a side of the locking dog (61).

2. The device of claim 1, comprising a backup assembly (30, 31) arranged on each side of the annular press element (19).

3. The device of claim 1, wherein the backup assembly (30, 31) comprises a series of arcuated backup elements (30A) adjoining an outer side of the annular element (19, 20), the arcuated elements having wings (44) and mating slots (45) to overlap.

4. The device of claim 3, wherein the backup elements (30A) are carried by a surrounding sleeve (29, 21B) by radial bolts (32), and a dish spring packet (33) is disposed on each bolt for ensuring that the backup elements are retracted.

5. The device of claim 1, wherein the annular press elements (19, 20) have a radially inward converging cross section.

* * * * *